United States Patent [19]

Balbi et al.

[11] Patent Number: 4,646,653

[45] Date of Patent: Mar. 3, 1987

[54] CORNER FITTING FOR OPEN TOP RAILROAD CAR

[75] Inventors: Philip A. Balbi, St. Charles County; John W. Coulborn, Warren County, both of Mo.

[73] Assignee: ACF Industries, Incorporated, Earth City, Mo.

[21] Appl. No.: 711,177

[22] Filed: Mar. 13, 1985

[51] Int. Cl.[4] ..... B61D 17/06; B61D 17/08

[52] U.S. Cl. ..... 105/406.1; 105/409; 296/29

[58] Field of Search ..... 105/406 R, 409, 410, 105/411, 247, 248, 404; 296/29, 183, 30

[56] References Cited

U.S. PATENT DOCUMENTS

| | | | |
|---|---|---|---|
| 1,071,699 | 9/1913 | Campbell | 105/248 |
| 1,686,748 | 10/1928 | Hardin | 105/411 |
| 2,489,670 | 11/1949 | Powell, Jr. | 296/183 |
| 3,772,997 | 11/1973 | Heap et al. | 105/406 R |
| 4,079,676 | 3/1978 | Miller | 105/406 R X |
| 4,306,505 | 12/1981 | Zehnder et al. | 105/406 R |
| 4,331,083 | 5/1982 | Landregan et al. | 105/406 R |

OTHER PUBLICATIONS

W083/01930 published 9 Jun. 1983, Ruhmann et al, "Filament Wound Railway Hopper Car".

*Primary Examiner*—Randolph A. Reese

*Attorney, Agent, or Firm*—Polster, Polster and Lucchesi

[57] ABSTRACT

In a stub sill open top railroad car, such as a gondola or hopper car particularly adapted for coal service, a corner fitting or casting is provided at each end of the car joining the top chord extending along each side of the car with the end chord, the latter extending transversely of the car at the upper ends thereof. The corner casting includes projections which extend into the top and end chords so as to facilitate making an integral (i.e., welded) connection between the chords and an adjacent end diagonal member. In one embodiment, the casting includes a downwardly extending portion which is received within and to which the diagonal is welded, while in another embodiment, a connection plate is utilized to secure the end diagonals to the corner casting.

2 Claims, 8 Drawing Figures

CORNER FITTING FOR OPEN TOP RAILROAD CAR

BACKGROUND OF THE INVENTION

In the construction of a stub sill, open top gondola or hopper railroad car, assembly difficulties have been encountered in joining the top chords extending along the upper sides of the car to the transversely extending end chords of the car. In addition, assembly difficulties have also occurred in joining the end diagonals of the stub sill car which are required for reacting the overturning component or the coupler loads at the car ends. Still other assembly difficulties have been encountered in joining the side and end sheets at the corners of the car to the top and end chords and to the end diagonals. In the past, this joining work (e.g., welding) has required considerable hand fitting and jigs. Additionally, load paths through the corner connections of prior art railroad cars made from fabricated steel parts were generally discontinuous (i.e., the load paths were comprised of a number of separate parts welded together) and, therefore, did not result in efficient load transfer (i.e., excess structural material was required to ensure that the loads were properly transferred).

Heretofore, steel castings have been used to join the end and side chords of the car. However, these prior art corner castings nevertheless resulted in discontinuous load paths between the end diagonals and the side and end chords. Even with the prior art castings, considerable hand fitting work was required to make the connections between the chords, the end diagonals, and the side and end sheets. In addition to resulting in discontinuous and inefficient load paths, as mentioned above, these prior art designs also varied in load carrying capability from one car to another and were, in some instances, dependent on dimensional variations from car-to-car and the manner in which the various components were hand-fitted during assembly.

Thus, there has been a long-standing need for a structure for an open top gondola or hopper railroad car in which the end and top chords could be efficiently joined together with the end diagonals, and in which the side and end sheets could be secured to the chords and to the end diagonals in a repeated and reliable fashion from car to car.

SUMMARY OF THE INVENTION

Among the several objects and features of the present invention may be noted the provision of a corner casting or fitting for an open top railroad car (e.g., a hopper or gondola car) in which a convenient manner of joining (e.g., welding) the top chord extending along the side of the car to the end chord extending transversely along the end of the car is provided;

The provision of such a corner casting which conveniently joins the end diagonals of the car with the transversely extending end chord;

The provision of such a corner casting which efficiently joins the chords and diagonals to the end and side sheets of the car;

The provision of such a corner casting which optimizes the design for strength requirements and for load transfer paths so as to provide a positive and repeatable interface between the end and side chords and the side and end sheets, and so as to provide a dimensionally repeatable weld joint between the various components thereby to provide consistency in weld joint fabrication and strength requirements from car-to-car;

The provision of such a casting which enables a variety of welding procedures to be utilized during fabrication of the car which increase the strength of the welded connections and which enhance productivity;

The provision of such a corner casting which provides a positive location of the end diagonals and the end slope sheets relative to the end and side chords; and The provision of such a casting which improves car strength, which lessens the materials used and hence lessens the weight of the car while maintaining car strength, which lessens labor during car fabrication, which has a long service life, which is of rugged construction, and which is thus cost efficient.

Other objects and features of this invention will be in part apparent and in part pointed out hereinafter.

Briefly stated, this invention relates to a center stub sill, open top railroad car, such as a gondola or open top hopper car, having side chord members extending lengthwise along the upper sides of the open top car and an end chord extending transversely along the upper ends of the open top car. The car further has side sheets extending downwardly from the top chords forming the sides of the car, and end sheets extending downwardly from the end chords forming the end walls of the car, with the intersection of the side and end chords and of the side and end sheets forming the corners of the car. Further, diagonal members are provided at each corner of the car extending downwardly and inwardly on the outer face of the end sheets toward the center stub sill of the car. More specifically, the improvement of this invention comprises an integral fitting or casting adapted to mechanically interfit with and to be welded to an end of a respective top chord and one end of said end chord at the corners of the car, this fitting also being structured so as to positively receive and to accurately locate the top chord member, the end chord member, the side sheet, and the end sheet relative to one another so as to facilitate welding of these members at each corner of the car.

BRIEF DESCRIPTION OF THE DRAWINGS

Corresponding reference characters indicate corresponding parts throughout the several view of the drawings.

DESCRIPTION OF PREFERRED EMBODIMENTS

Figure 1:
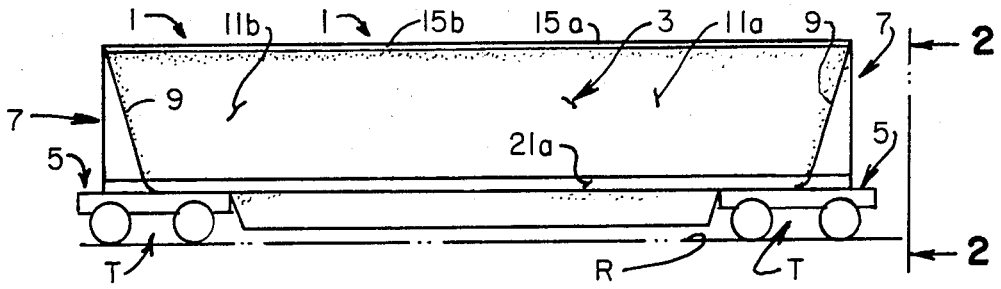
FIG. 1 is a side elevational view of a center stub sill open top gondola car, constructed in accordance with the present invention.

Referring now to the drawings, an open top railroad car, such as a gondola car or an open top hopper car, is indicated in its entirety by reference character 1. As best shown in FIG. 1, the railroad car includes a car body 3. Railroad car 1 has a center stub sill 5 at each end thereof, with the car riding on conventional trucks T, pivotally affixed to the center stub sill in the conventional manner. Trucks T ride on rails R. Each end of the car body is reinforced by an end frame, as generally indicated at 7.

Figure 3:
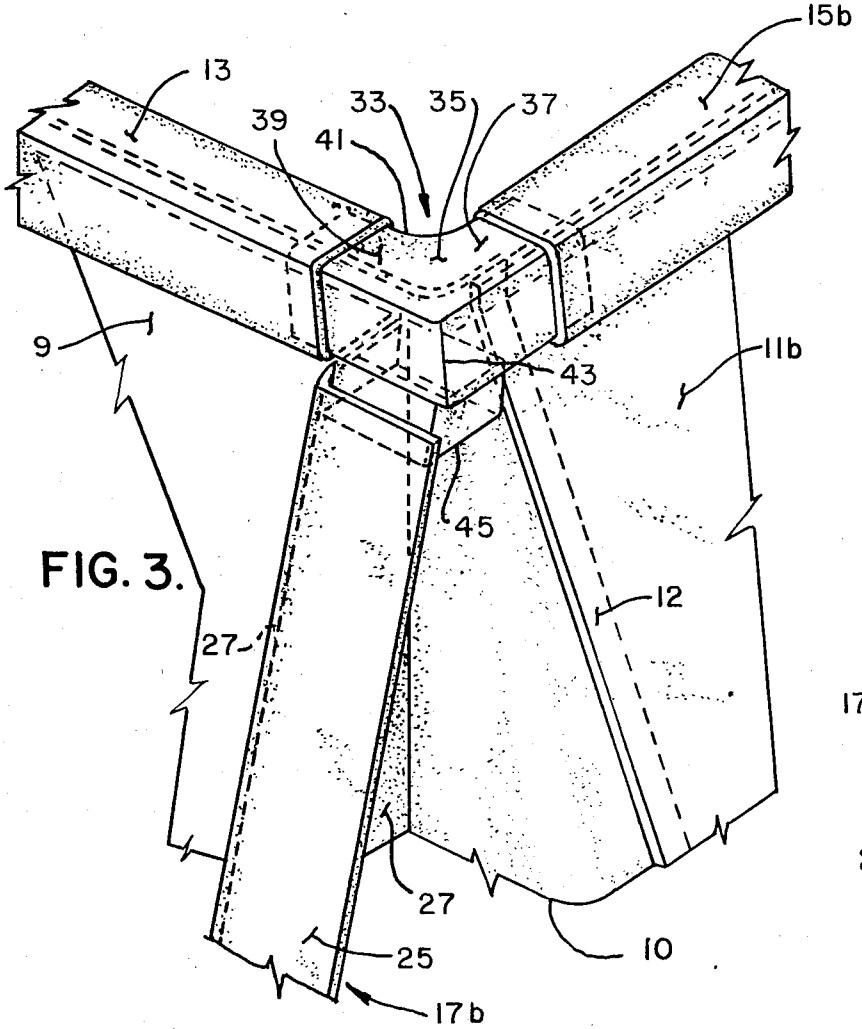
FIG. 3 is an enlarged perspective view of the upper righthand corner of the car in the area generally indicated by line 3—3, illustrating a corner fitting or casting of the present invention.
Figure 5:
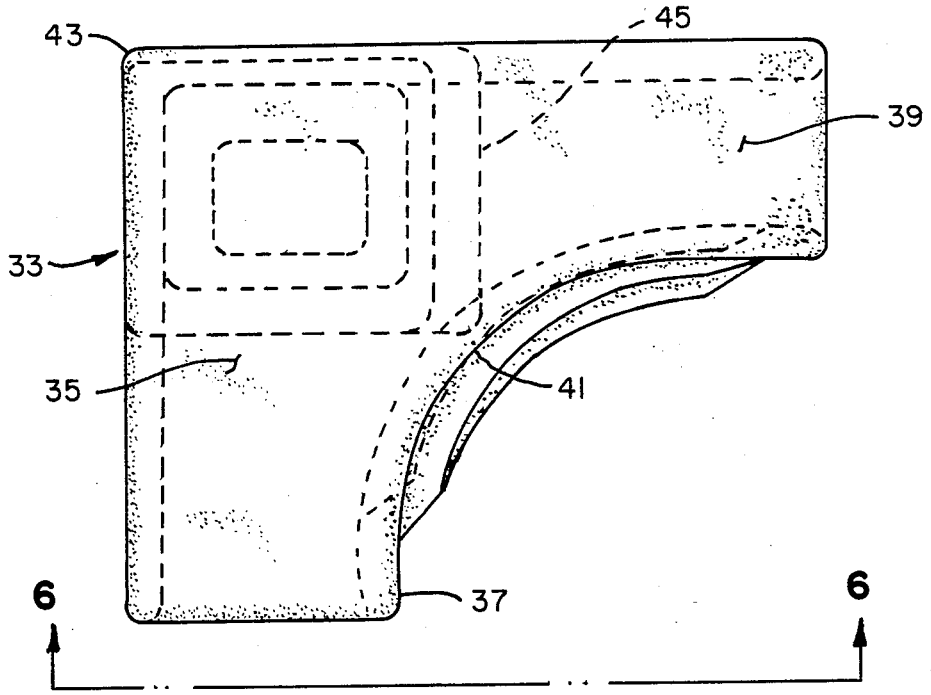
FIG. 5 is a top plan view of the corner casting shown in FIGS. 3 and 4.
Figure 6:
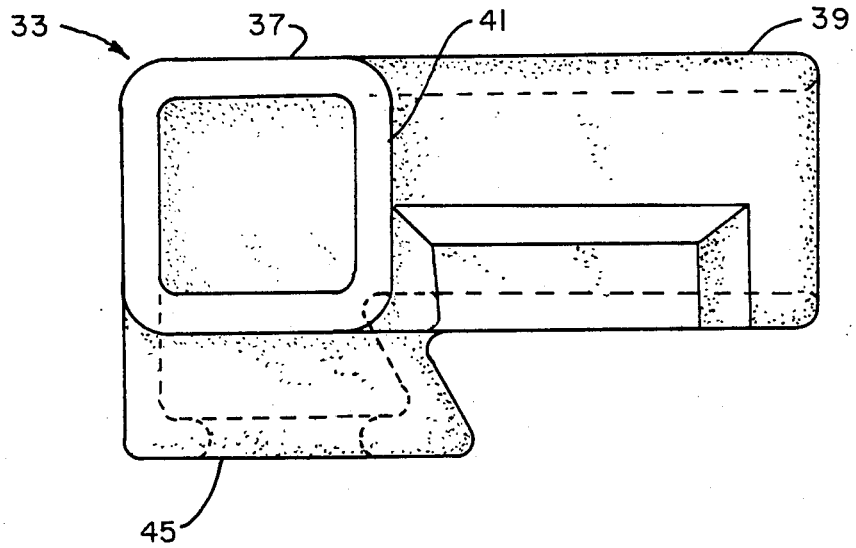
FIG. 6 is an elevational view of the corner casting, taken along line 6—6 of FIG. 5.

More particularly, car body 3 includes end sheets 9 at each end of the car, with these end sheets having a slight draft or taper, such that the length of the car is slightly greater at its top than at the bottom of the car body. Generally, end sheets 9 are one-piece parts formed of suitable steel plate material, and have end sheet corners 10 (as best shown in FIG. 3) at the outer vertical ends thereof for purposes as will appear. Additionally, car body 3 is comprised by side sheets 11*a*, 11*b* at each side of the car secured to the end sheet corners 10 and extending longitudinally of the car forming the sides of the car body. It will be appreciated that the end sheet corners 10 overlap with their respective side sheets 11*a*, 11*b*, with this overlap being indicated by reference character 12, so as to provide a lap joint for weld fabrication purposes. The upper ends of end sheets 9 are reinforced by an end chord 13, and the upper edges of the side sheets 11*a*, 11*b* are reinforced by respective side chords 15*a*, 15*b*. As shown, the end chords and the side chords are formed from square structural tubular members and extend the length of the car body ends and car sides. These chord members reinforce the upper edges of end sheets 9 and side sheets 11*a*, 11*b*, and help reinforce the side sheets so that they will withstand lading loads and train loads.

Figure 2:
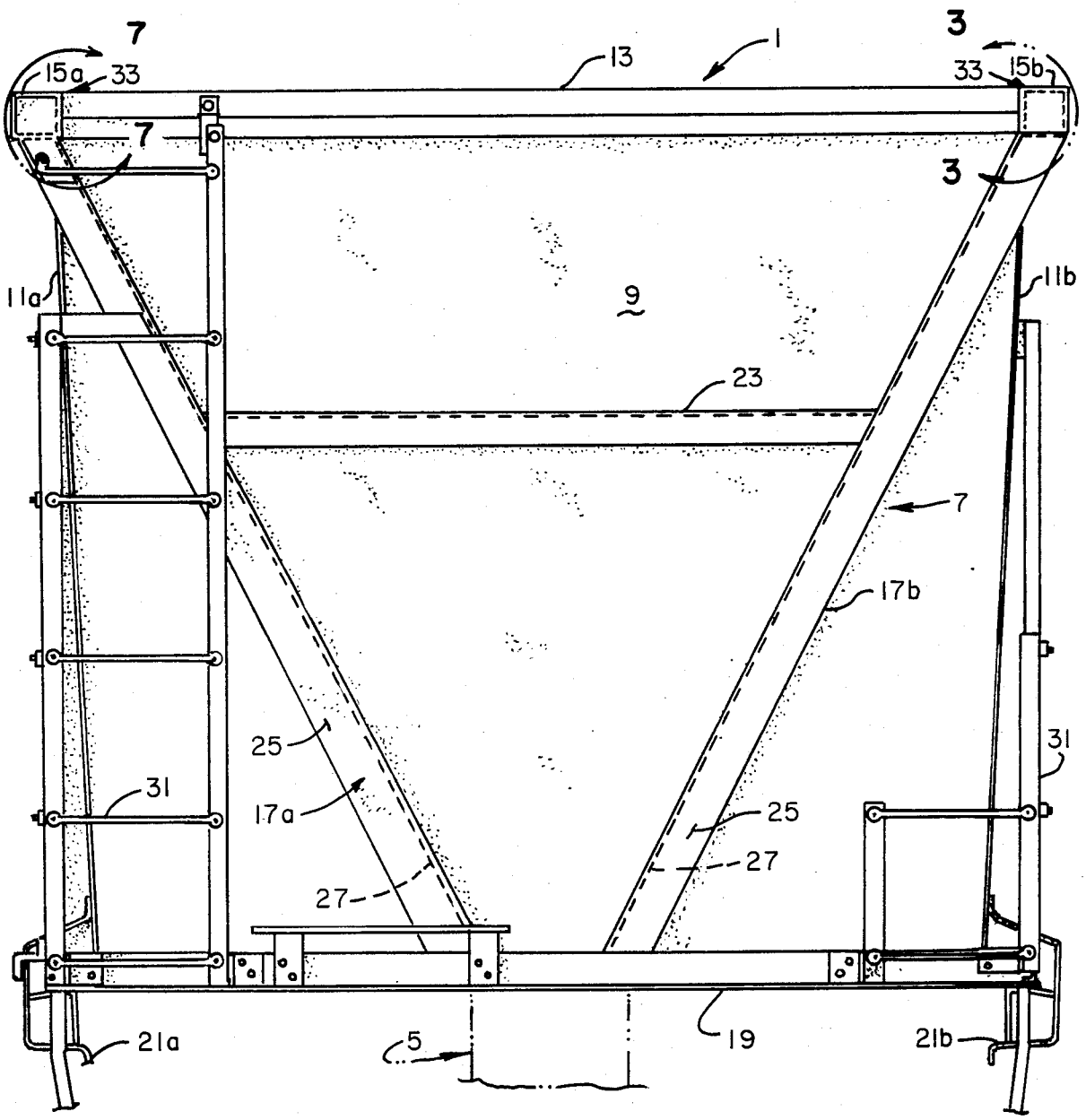
FIG. 2 is an end elevational view, taken along line 2—2 of FIG. 1, on an enlarged scale, showing the end structure of the car.
Figure 4:
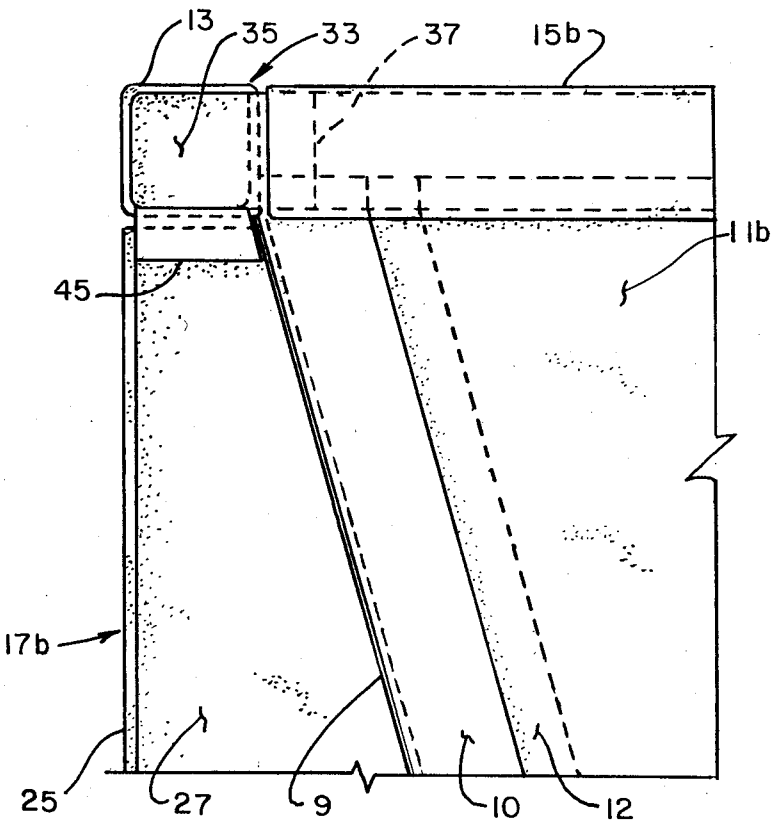
FIG. 4 is a right side elevational view of FIG. 3.

The end frame 7 of the car is shown to comprise a pair of end diagonals, as indicated at 17*a*, 17*b*, secured to the outer face of each respective end sheet 9, with the diagonals extending from end chords 13 downwardly to a shear plate 19. As is typical, shear plate 19 is secured to center stub sill 5, generally above trucks T, and the shear plate extends laterally outwardly to the sides of the car. Side sills, as indicated at 21*a*, 21*b*, extend longitudinally of car body 3 along the lower margins thereof, and these side sills are rigidly secured to the outer margins of the shear plate so as to transmit train action loads from the center stub sill 5 laterally outwardly to the side sills. The side sills, in turn, transfer train action loads longitudinally along the car, and thus tie the stub sills 5 at each end of the car together. The end frames 7, and particularly the end diagonals 17*a*, 17*b*, transmit certain overturning loads and moments from the upper portions and end sheets of the car to the shear plate and to the center stub sill assembly 5. As best shown in FIG. 2, diagonals 17*a*, 17*b* incline inwardly from the upper corners of the car body generally proximate the juncture of the side and end chord members, and converge inwardly and downwardly so as to mate with shear plate 19 above the location of center stub sill assembly 5. The end frame further includes transverse reinforcement members, as indicated at 23, extending between the end diagonals. The end diagonals 17*a*, 17*b* are generally angle-shaped in cross section, having an outer end leg 25, and having a longitudinal leg of varying depth extending inwardly from end leg 25 into abutting relation with the outer face of end plate 9. The inner edges of longitudinal legs 27 are welded to the outer face of end sheet 9, and the transverse reinforcement members 23 are welded to the inner faces of the longitudinal legs 27 of end diagonals 17*a* and 17*b*. In this manner, the end frame 7 at each end of the car is constituted by a rigid weldment. As shown in FIG. 2, various ladders 31 and other appurtenances may be added to the car to faciliate train attendants in loading, unloading, and transporting the car.

As above-described, railroad car 1 is of substantially conventional construction. Heretofore, such cars were fabricated by assembling the above-described end sheets, side sheets, top and end chords, and diagonals relative to one another, and by welding these various components together. However, because of the sheer size of the railroad car, and because of the length and the amount of welds required to rigidly join the various components together, it was a difficult matter to hold all the various components in their desired respective positions relative to one another such that the components were accurately positioned relative to one another, and such that the components could be maintained in their desired relative positions during welding. It will be appreciated that during welding, the heat of welding causes thermal distortions of the various components, and even though they may initially be properly positioned relative to one another, after welding, distortion may be present.

In accordance with the present invention, an integral corner fitting casting, as generally indicated at 33, may be provided at each upper corner of the car, generally at the intersection of each end chord 13, with side chords 15*a*, 15*b* so as to securely locate the end and side chords relative to one another, as well as to position the upper margins of the end and side sheets relative to one another and to their respective end chords and side chords, and also so as to position the upper portions of end diagonals 17*a*, 17*b* relative to their desired location with respect to the upper corners of the car. More specifically, corner fitting 33 is preferably a unitary casting of cast steel or other weldable material, including a corner body portion 35. The corner body portion includes a side chord arm 37 and an end chord arm 39 generally at right angles with respect to one another. The corner body also has an inner body corner 41, which is radiused or curved so as to generally mate with end sheet corner 10 formed on the outer vertical edges of each end sheet 9. Additionally, corner body 35 has an outer body corner 43. While fitting 33 is herein preferably described as a unitary casting, it will be understood that within the broader aspects of this invention that the fitting may be a weldment or the like.

More specifically, each of the side and end chord arms 37 and 39, respectively, of corner body 35 are of generally square cross section and are sized so as to fit readily, but generally snuggly, within the hollow open ends of their respective end chords 13 and side chords 15*a*, 15*b*. It will be recalled that the end chords and side chords are preferably of hollow, square structural tubing construction. The length of side chord arms 37 and end chord arms 39 is sufficient such that these side and end chord arms are received within the ends of the square tubular end and side chord members for positively interconnecting them together. In this manner, a welding shoulder is formed at the juncture of the ends of the side and end chord members and the portion of the side chord arms and end chord arms received within the chord members such that a convenient weld may be utilized to secure the end and side chords to the corner casting. It will also be appreciated that since the side chord arms 37 and the end chord arms 39 are rigidly fixed to one another in their desired perpendicular positions due to the integral construction of casting body 35, the corner casting 33 serves to positively locate end chord 13 with respect to its respective side chord member 15*a* or 15*b* at each corner of the car. Additionally, the side and end chords are positively maintained in their desired perpendicular positions relative to one another by corner casting 33 during welding of the chord members to the corner casting, and also during welding of the other components constituting car body 3.

Further, corner casting 33 includes a downwardly protruding leg 45 of generally square cross section, with this leg angling inwardly and downwardly generally along the desired position of a respective end diagonal 17*a* or 17*b*. As best shown in FIG. 3, the inner face of leg 45 disposed below end chord arm 39 is adapted to engage the inner face of the longitudinal leg 27 of a respective end diagonal, such as end diagonal 17*b* shown in FIG. 3. Likewise, the end face of the downwardly projecting casting leg 45 is adapted to engage the inside face of end leg 25 of end diagonal 17*b*. In this manner, the end diagonal is properly positioned with respect to the corner casting, and is thus automatically properly positioned with respect to the end and side chords, and with respect to the end and side sheets at each corner of the car. Further, as shown in FIG. 3, the overlapping fashion of the end leg 25 and the longitudinal leg 27 of the end diagonal on casting leg 45 provides a good welding surface for running a weld between the upper ends of the end diagonal and casting leg 45. Thus, end casting 33 serves as an integral member which efficiently transfers loads between end sheet 9, side sheets 11*a* or 11*b*, end chord 13, a respective side chord 15*a* or 15*b*, and a respective end diagonals 17*a* or 17*b* at each corner of the car body 3. Additionally, the corner casting serves to locate all of these above-mentioned parts to one another prior to and during welding, thus facilitating welding of the car body structure, and also eliminating certain tooling and fixtures required for welding.

Figure 8:
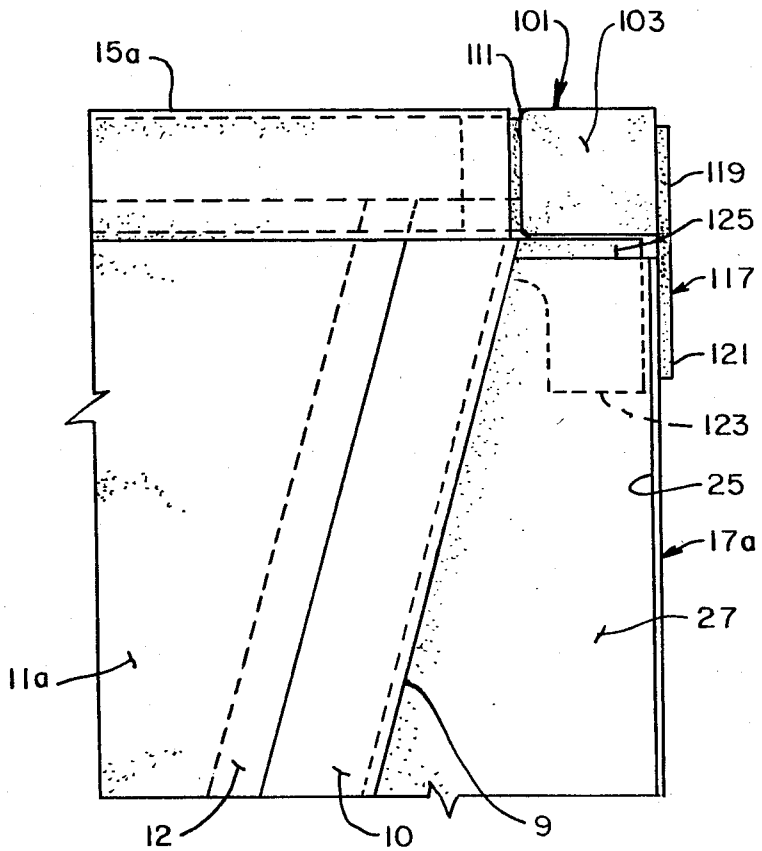
FIG. 8 is a right side elevational view of FIG. 7.
Figure 7:
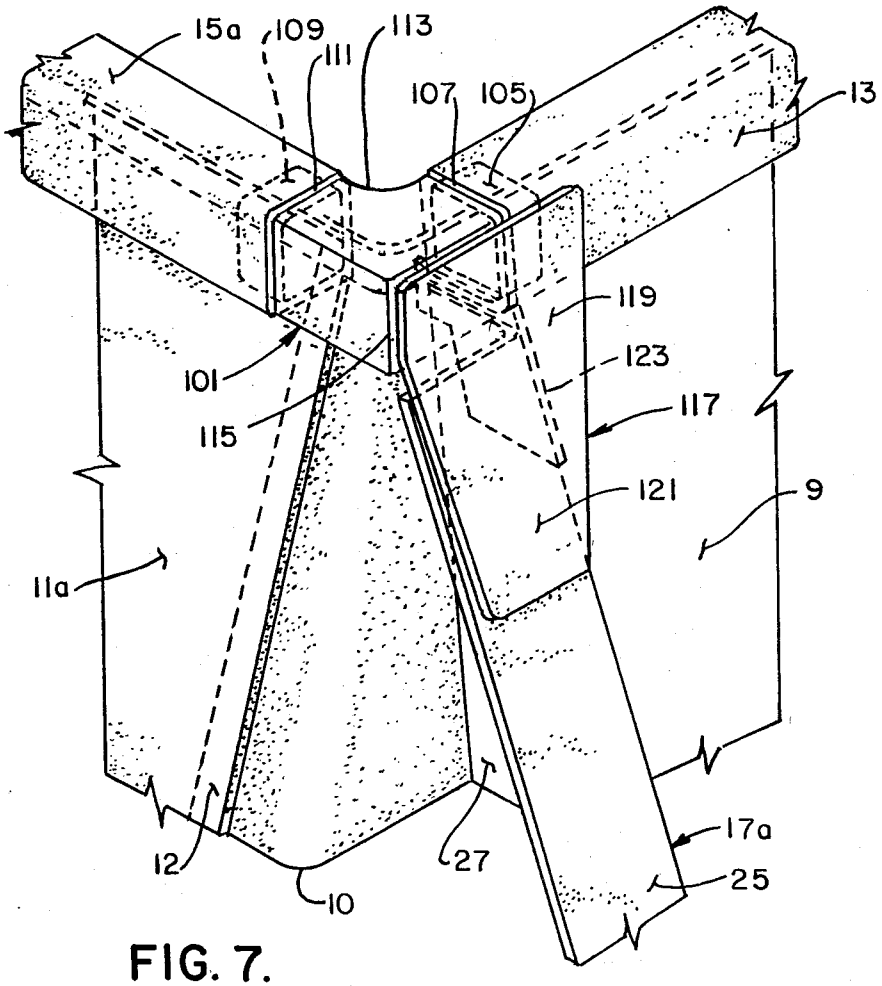
FIG. 7 is a view similar to FIG. 3, taken along line 5—5 of FIG. 3, showing an alternative embodiment of the corner casting of the present invention.

Referring now to FIGS. 7 and 8, an alternate embodiment of the corner fitting of the present invention is indicated in its entirety by reference character 101. More specifically, corner casting 101 includes a corner body 103 having an end chord arm 105 which is of a smaller cross section than the inner portion of the corner body so as to fit snuggly within the open end of the hollow box beam constituting end chord 13. A shoulder 107 is provided between end chord arm 105 and the main corner body, with this shoulder 107 acting as a stop so as to positively locate corner casting 101 with respect to the end of end chord 13. Likewise, on the other side of corner casting 101, a side chord arm 109 is provided which fits snuggly within the open end of its respective side chord 15*a* or 15*b*. A shoulder or step 111 is provided between side chord arm 109 and the main corner casting body 103 and, again, shoulder 111 serves as a stop for positively locating its respective side chord member 15*a* or 15*b* with respect to the corner casting. Also, both of these shoulders 107 and 111 provide a convenient weld surface when their respective chord members are abutted thereagainst to permit a lap weld joint between the corner casting and their respective chord members. Further, corner body 103 has an inner radiused corner 113 and an outer corner 115.

On the front side of corner bracket 101 (as viewed in FIG. 7), a so-called cover plate 117 is welded to the front face of end chord 13, to the front face of corner body 103, and to the upper portion of end leg 25 of a respective end diagonal 17*a* or 17*b*. Cover plate 117 includes an upper portion 119 which overlies the end face of end chord 13 and the end face of corner body 103, and a lower portion 121 which overlies and which is welded to the outer flange 25 of end diagonal 17*a* or 17*b*. The inner or longitudinal leg 27 of end diagonal 17*a* (as viewed in FIG. 7) is secured to the bottom face of its adjacent end chord 13*a* and to corner casting 101 by means of a gusset plate 123. Gusset plate 123 is generally an inverted L-shaped member having its main body portion adapted to lie against the upper reaches of longitudinal leg 27, and having its upper edge in abutting relation with the bottom face of end chord 13 such that a fillet weld can readily be run along the juncture of the upper edge 125 (see FIG. 8) of gusset plate 123 and the bottom face of the end chord. Likewise, the remaining peripheral edges of gusset plate 123 may be readily welded to longitudinal leg 27. In this manner, through the use of end cover plate 117 and gusset plate 123, the end diagonals 17*a*, 17*b* may be readily welded to the corner casting 101 and to the end and side chords in such manner that an efficient load path is provided between the corner casting, the side chords, and the end chords and the end diagonals and such that reaction loads resisting overturning moments between the center stub sill 5 and shear plate 19 and the upper side chords 15*a*, 15*b* of the car are efficiently carried through the corners of the car.

Those skilled in the art will recognize that the shoulders 107 and 111 of fitting 101 may also be utilized on fitting 33.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In an open top railroad car having a center stub sill at each end thereof, and a car body extending between said center stub sills, said center stub sils and said car body being supported on a truck at each end of said car, said body comprising a pair of spaced side sheets extending lengthwise of said body, an end sheet at each end of the body, a side chord secured to the upper margin of each of said side sheets, end chords secured to the upper margin of each of said end sheets, and an end frame including a pair of end diagonals interconnecting each end of the car and its respective center stub sill exteriorly of said end sheets, said car body having upper corners generally proximate the intersections of said end and side chords and a respective said end diagonal, wherein the improvement comprises: a one-piece corner fitting at each of said upper corners of said body for interconnecting a respective said side chord, said end chord, and said end diagonal, said corner fitting being of a metal alloy weldable to said side and end chords and to said side and end sheets, said corner fitting having a side chord arm and an end chord arm at substantially right angles with respect to one another, said arms interfitting with the end portions of said side and end chords proximate said upper corner and being welded thereto, the upper end of a respective said end diagonal terminating proximate a respective upper corner of said car body, and means integral with said corner fitting for securely joining said end diagonal to said fitting wherein said side and end chord members, said end and side sheets, and said end diagonal at one of said upper corners are efficiently and securely secured to one another via said fitting, said side and end chords have an open hollow end proximate each of said upper corners of said car body, and wherein said end and top chord arms of said fitting are received within said hollow open ends of said respective side and end chords thereby to interconnect said side and end chords to said corner fitting, said means for securely joining said end diagonal to said corner fitting comprising a cover plate engageable with a portion of said end chord and said corner fitting, and engageable with said end diagonal.

2. In a railroad car as set forth in claim 1 wherein said end diagonal securing means further comprises a gusset plate interconnecting said end diagonal to said end chord.

* * * * *